US006308035B1

(12) United States Patent
Fukuda

(10) Patent No.: US 6,308,035 B1
(45) Date of Patent: Oct. 23, 2001

(54) DEVELOPING DEVICE FOR AN IMAGE FORMING APPARATUS

(75) Inventor: Yoshiyuki Fukuda, Tokyo (JP)

(73) Assignees: Toshiba Tec Kabushiki Kaisha, Tokyo; Kabushiki Kaisha Toshiba, Kawasaki, both of (JP)

( * ) Notice: Subject to any disclaimer, the term of this patent is extended or adjusted under 35 U.S.C. 154(b) by 0 days.

(21) Appl. No.: 09/468,541

(22) Filed: Dec. 21, 1999

(30) Foreign Application Priority Data

Dec. 22, 1998 (JP) ..... 10-365605

(51) Int. Cl.[7] ..... G03G 15/08
(52) U.S. Cl. ..... 399/254; 399/267; 399/272
(58) Field of Search ..... 399/254–256, 399/267, 272, 281

(56) References Cited

U.S. PATENT DOCUMENTS 4,940,014 * 7/1990 Saijo et al. ..... 399/256
5,758,240 * 5/1998 Ito et al. ..... 399/267
5,991,583 * 11/1999 Nozawa ..... 399/254
6,035,168 * 3/2000 Masuda et al. ..... 399/254
6,122,472 * 9/2000 Sako et al. ..... 399/254
6,144,829 * 11/2000 Miyasaka et al. ..... 399/281

FOREIGN PATENT DOCUMENTS 5-333691 12/1993 (JP) .

* cited by examiner

*Primary Examiner*—William J. Royer
(74) *Attorney, Agent, or Firm*—Foley & Lardner

(57) ABSTRACT

The present invention provides for a developing device comprising a developing roller configured to supply developer to a developing portion, a first conveying path configured to guide a moving of the developer and from which the developer is supplied by the developing roller to the developing portion, a first mixer configured to mix the developer while the developer is moving along the first conveying path, a second conveying path configured to guide the moving of the developer, wherein a residual developer left on the developing roller is recovered to the second conveying path and conveyed to the first conveying path, a second mixer configured to mix the developer while the developer is moving along the second conveying path, and a partition member arranged between the developing roller and the first conveying path to prevent leakage of the developer from between the developing roller and the first conveying path to the second conveying path directly, wherein one end of the partition member is brought in contact with the developing roller.

21 Claims, 5 Drawing Sheets

DEVELOPING DEVICE FOR AN IMAGE FORMING APPARATUS

BACKGROUND OF THE INVENTION

1. Field of the Invention

The present invention relates to a developing device that is applicable to, for instance, electrophotographic copying machines.

2. Description of the Related Art

A developing device of this type, equipped with a developing magnet roller and upper and lower mixers, circulates developer along upper and lower conveying paths by rotating the upper and lower mixers and develops images by supplying developer to the developing magnet roller from a developer accumulating portion via the upper conveying path.

Further, after developing images, residual developer remaining on the developing magnet roller is recovered and conveyed along the lower conveying path.

By the way, the developer accumulating portion and the lower conveying path are communicated with each other and developer tends to leak from the developer accumulating portion to the lower conveying path. Leakage (flow) of developer to the lower conveying path is prevented because developer is retained by the magnetic force of a conveying pole located close to the developer accumulating portion of the developing magnet roller.

However, in conventional developing devices, developer is retained by the magnetic force of the conveying pole and if the magnetic force of the conveying pole drops, the developer leaks (flows) from the developer accumulating portion to the lower conveying path and the circulation of developer is unbalanced. That is, there was such a defect that developer in the upper conveying path decreases, amount of developer supplied to the developing magnet roller via the developer accumulating portion drops and in the worst case, developer may not be supplied.

Further, when the magnetic force of the conveying pole is too high, used developer is drawn in the developer accumulating portion from the lower conveying path and an image density is apt to drop.

SUMMARY OF THE INVENTION

An object of the present invention is to provide a developing device that is capable of preventing leakage (flow) of developer from a developer accumulating portion to a lower conveying path without relying on the magnetic force of a conveying pole and drawing-up of used developer from a lower conveying path.

According to the present invention, a developing device is provided. The developing device comprises a developing roller configured to supply developer to a developing portion, a first conveying path configured to guide a moving of the developer and from which the developer is supplied by the developing roller to the developing portion, a first mixer configured to mix the developer while the developer is moving along the first conveying path, a second conveying path configured to guide the moving of the developer, wherein a residual developer left on the developing roller is recovered to the second conveying path and conveyed to the first conveying path, a second mixer configured to mix the developer while the developer is moving along the second conveying path, and a partition member arranged between the developing roller and the first conveying path to prevent leakage of the developer from between the developing roller and the first conveying path to the second conveying path directly, wherein one end of the partition member is brought in contact with the developing roller.

DETAILED DESCRIPTION OF THE PREFERRED EMBODIMENTS

Figure 1:
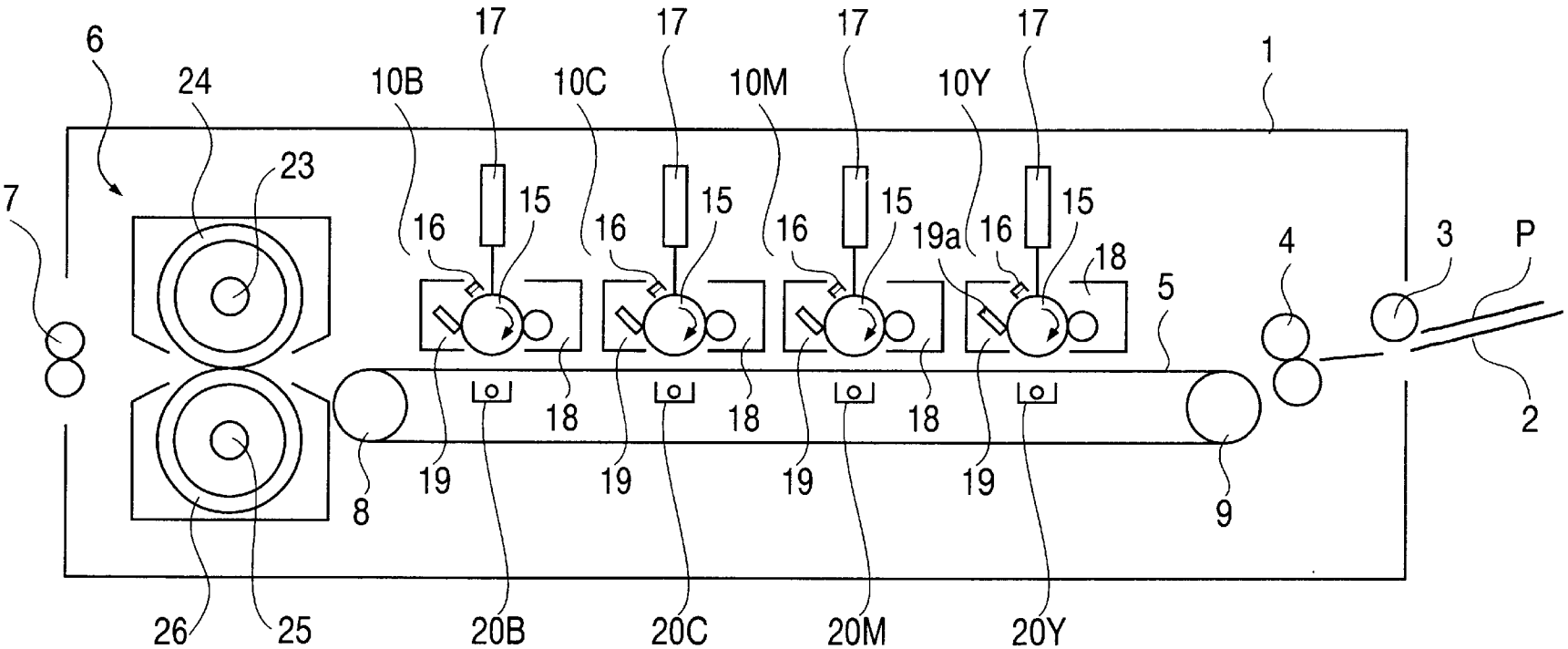
FIG. 1 is an internal block diagram showing an image forming apparatus to which a developing device of the present invention is applicable.

The present invention will be described below with reference to embodiments shown in the drawings.

FIG. 1 is an internal block diagram showing an image forming apparatus. There is a paper feeder 2 equipped with a paper feed roller 3 provided on one side of a main body (1).

In the main body (1), there are an aligning roller pair 4 to align paper P, a conveyer belt 5 to convey paper P, a fixing device 6 to fix an image on paper P, and an exit roller pair 7 to exit paper P having a fixed image are provided in order along the conveying direction of paper P.

The conveyor belt 5 is manufactured by, for instance, semiconductive polyimide and has a characteristic stabilized from the viewpoint of thermal as well as abrasion resistance. The conveyor belt 5 is put between a driving roller 8 and a driven roller 9. The driven roller 9 is given with a tension so that the conveyor belt 5 travels without being loosened.

Above the conveyor belt 5, there are process units 10Y, 10M, 10C and 10B provided in the conveying direction of paper P. Yellow, magenta, cyan and black toners are used in the process units 10Y, 10M, 10C and 10B, respectively.

Each of the process units 10Y, 10M, 10C and 10B is provided with a photosensitive drum 15 and around this photosensitive drum 15, there are a main charger 16, a optical laser beam unit 17, a developing device 18 and a cleaning device 19 arranged in order along the rotating direction of the photosensitive drum.

At the inside of the conveyor belt 5, transfer devices 20Y, 20M, 20C and 20B are arranged. These transfer devices are facing the photosensitive drums 15 in the process units 10Y, 10M, 10C and 10B via the conveyor belt 5.

The fixing device 6 comprises a fixing roller 24 that is heated by a heat lamp 23 and a pressure roller 26 that is provided under the fixing roller 24, press fitted and heated by a heat lamp 25.

Next, the image forming operation will be described.

The surfaces of the photosensitive drums 15 of the process units 10Y, 10M, 10C and 10B are uniformly charged to, for instance, about −700V by the main charger 16. Then, the laser beam is applied to each of the photosensitive drums 15 by an optical laser beam unit 17 corresponding to an image signal. On each of the photosensitive drums 15, resistance on a portion applied with the laser beam decreases, the minus charge is discharged and an electrostatic latent image is formed. Further, a semiconductive laser is normally used as a laser and laser beam modulated according to an image is scanned by a rotary polygonal mirror (not shown). An electrostatic latent image thus formed is developed by a developing device 18. That is, a toner that is fine color particles minus charged by the reversal development is given with developing bias of about −500V and adhered to the portion where the minus charge of the electrostatic latent image was discharged on each photosensitive drum 15. By this adhered toner, an electrostatic latent image is visualized and magenta, cyan or black color image is formed.

On the other hand, at this time, a sheet of paper P is fed from the paper feeder 2 and this sheet of paper P is taken in by the rotation of the paper feed roller 3. This sheet of paper P taken in is aligned by the aligning roller pair 4, placed on the conveyor belt 5 at a proper timing and conveyed by the traveling conveyor belt 5. This sheet of paper P is fed between the photosensitive drums 15 and the transfer devices 20Y–20B, respectively and yellow, magenta, cyan and black color images are transferred on the sheet of paper P by the transfer devices 20Y–20B, respectively.

On the transfer devices 20Y–20B, a charge of about +1000 V is given to a sheet of paper P from its back via the conveyor belt 5. Thus, the yellow, magenta, cyan and black color images developed by the minus charged toners on the photosensitive drums 15 are attracted to and transferred on the sheet of paper P. A sheet of paper P on which a color image transferred is conveyed between the fixing roller 24 heated by the heat lamp 23 and the pressure roller 26 heated by the heat lamp 25, and heated and pressed by the fixing roller 24 and the pressure roller 26, the color image is fixed on the sheet of paper P, and the printing operation is completed. Thus, the printed paper P is ejected to the outside of the machine by the exit roller pair 7.

Further, the residual toner left on each of the photosensitive drums 15 without being transferred on a sheet of paper P during the development is scraped and removed by a cleaning blade 19*a* of each of the cleaning device 19.

Figure 2:
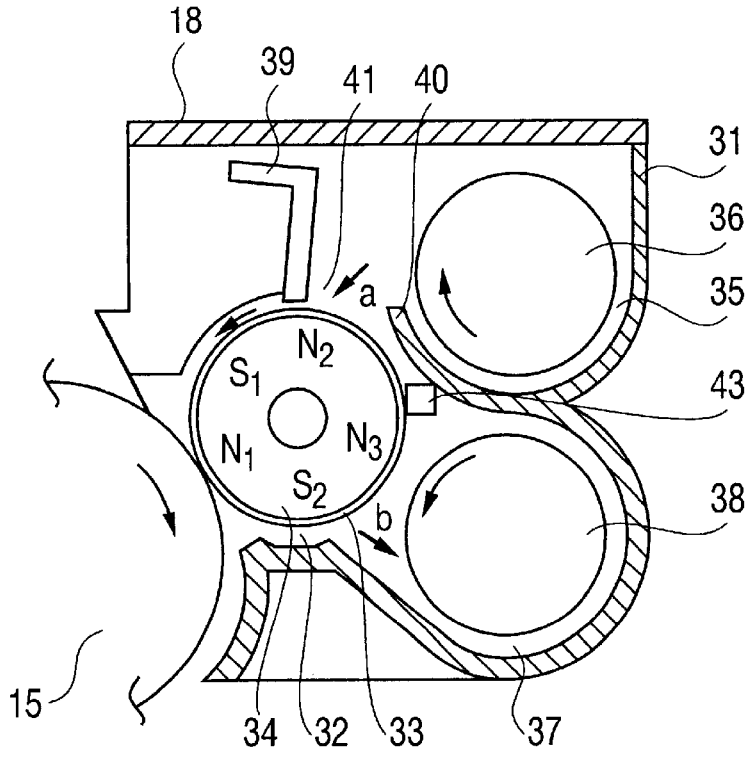
FIG. 2 is a vertical sectional view showing a first embodiment of the developing device of the present invention.
Figure 3:
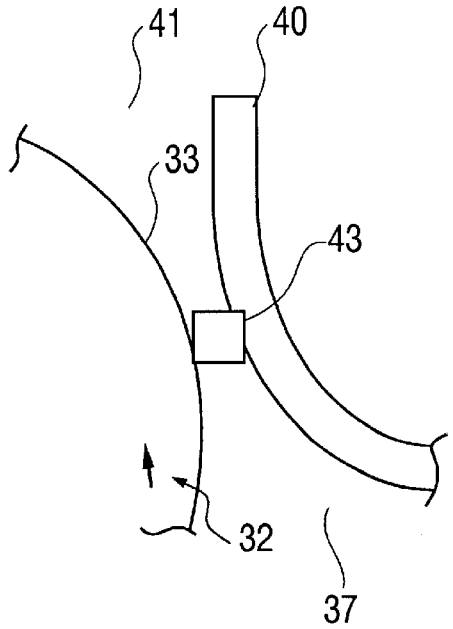
FIG. 3 is a schematic diagram showing an enlarged partition member that is used in the developing device shown in FIG. 3.

FIG. 2 is a vertical sectional view showing the above-mentioned developing device 18. This developing device 18 has a casing 31 and a developing roller 32 as a developing means to feed developer is provided in the casing 31. The developing roller 32 comprises a rotary sleeve 33 that rotates in the arrow direction and a magnet roller 34 that is fixed in the rotary sleeve 33. The developing roller 32 is facing the photosensitive drum 15. Above the developing roller 32, a doctor blade 39 is provided to form a thin layer of developer on the developing roller 32.

Further, in the casing 31, an upper mixer 36 is provided rotatably as a first stirring/conveying means to feed developer to the developing roller 32 via a developer accumulating portion 41 by mixing/conveying developer along an upper conveying path 35 as a first conveying path. Below the upper mixer 36, there is a lower mixer 38 as a second stirring/conveying means to circulate developer between it and the upper mixer 36 by mixing/conveying developer along the lower conveying path 37 as a second conveying path. The upper conveying path 35 and the lower conveying path 37 are partitioned with a guide 40.

Further, the developer accumulating portion 41 and the lower conveying path 37 are partitioned by a block material 43 that is used as a partition member as a partition means. The block material 43 is formed with, for instance, polyurethane foam. One end of the block material 43 is fixed to the guide 40 and the other end is kept in contact with the rotary sleeve 33 of the developing roller 32.

Next, the developing operation will be described.

During the development, the upper and lower mixers 36 and 38 are rotated and developer is mixed/conveyed and circulated upward and downward by the rotation of the mixers and at the same time, supplied to the developing roller 32 via the developer accumulating portion 41 by the rotation of the upper mixer 36 as shown by an arrow a (as shown in FIG. 2). This developer is supplied onto the photosensitive drum 15 by the rotation of the rotary sleeve 33 and an electrostatic latent image is developed. Then, the developer left on the rotary sleeve 33 after the development is sent to the lower mixer 38 and recovered as shown by an arrow b (as shown in FIG. 2).

By the way, there was so far no partition member between the developer accumulating portion 41 and the lower conveying path 37, developer is held by magnetic force of a magnetic pole N2 of the magnet roller 34 so as to prevent leakage of developer from the developer accumulating portion 41 to the lower conveying path 37.

Figure 8:
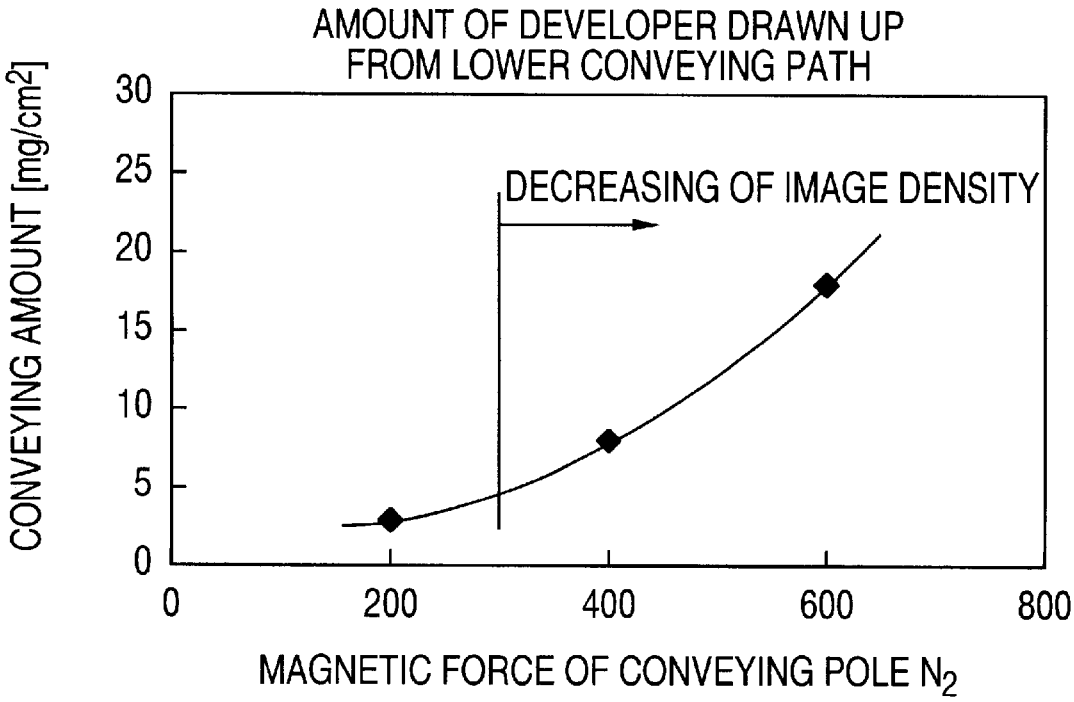
FIG. 8 is a graph showing the relationship between the magnetic force of a conveying pole and a conveying amount of developer.

However, according to this method, the quantity of used developer drawn up from the lower conveying path 37 increases if the magnetic force of the magnetic pole N2 is too high and the image density tends to drop as shown in FIG. 8.

Further, if the magnetic force is decreased in order to suppress the draw-up quantity from the lower conveying path 37, developer may possibly leak from the developer accumulating portion 41 to the lower conveying path 37 due to fluctuation of magnetic force of the magnetic pole N2 between solid matters.

In this embodiment, because the developer accumulating portion 41 and the lower conveying path 37 are partitioned with the block material 43 as mentioned above, developer in the developer accumulating portion 41 is kept therein by the block material 43 so that leakage of developer from the developer accumulating portion 41 to the lower conveying path 37 can be certainly prevented. At the same time, used developer flowing to the developer accumulating portion 41 from the lower conveying path 37 can be cut off by the block material 43 and is not drawn up.

Figure 4:
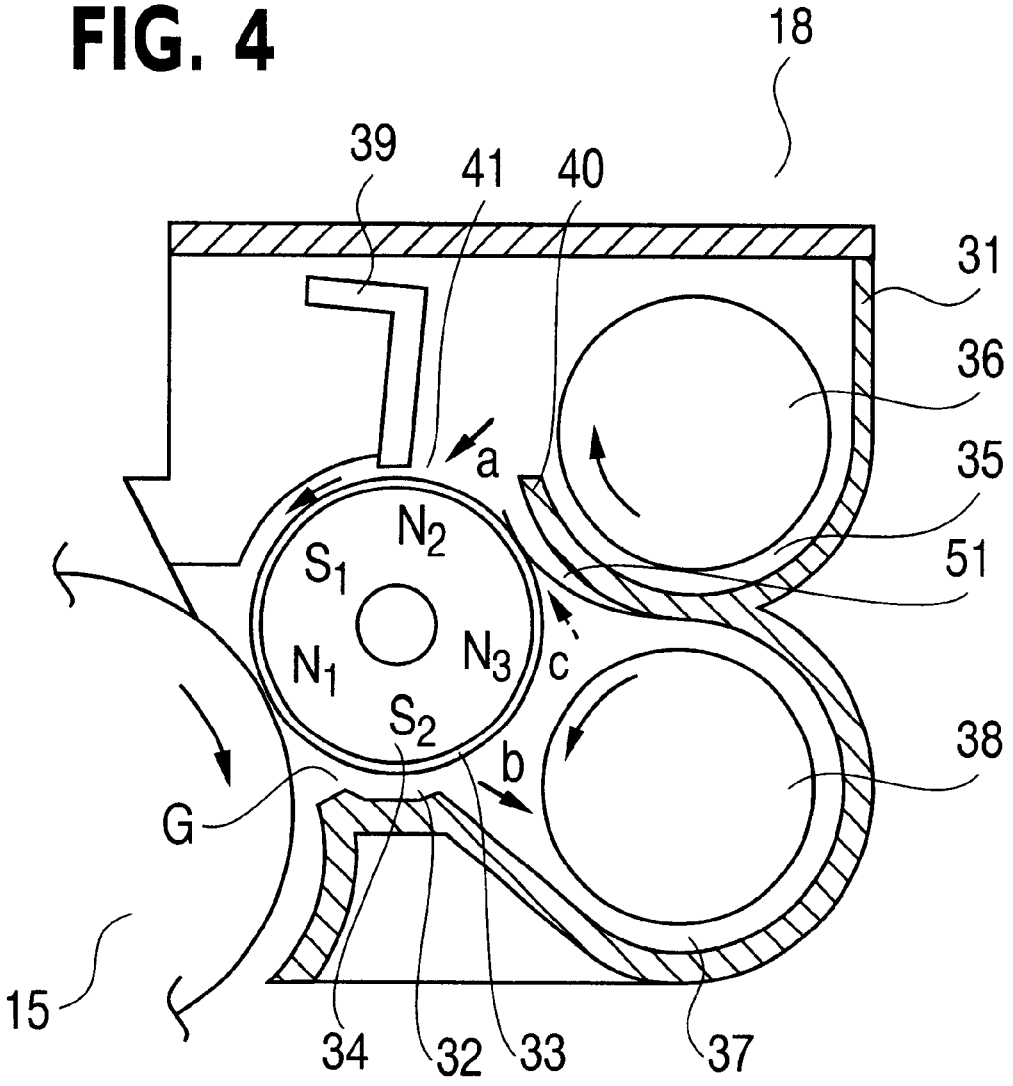
FIG. 4 is a vertical sectional view showing a second embodiment of the developing device of the present invention.

FIG. 4 shows the second embodiment of the present invention.

Further, the same component elements shown in the first embodiment will be assigned with the same reference numerals and the explanation thereof will be omitted.

In this second embodiment, a soft plate material 51 is used as a partition means to partition the developer accumulating portion 41 and the lower conveying path 37. As the soft plate material 51, a thin sheet material such as urethane rubber or Mylar rubber may be used.

Figure 5:
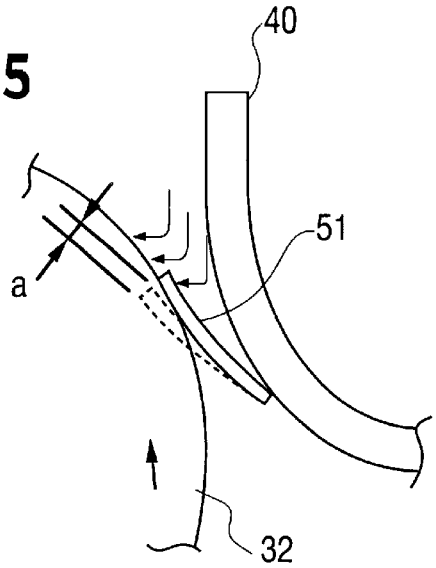
FIG. 5 is a schematic diagram showing the enlarged partition member that is used in the developing device shown in FIG. 4.

The lower end of the plate material 51 is a fixed end that is fixed to the guide 40 by a both-sided tape and the upper end is a contact end to contact the rotary sleeve 33 of the developing roller 32 as shown in FIG. 5. The plate material 51 has been mounted so that the direction from its fixed end to the contact end is the same direction as the rotary direction of the rotary sleeve 33 of the developing roller 32.

Accordingly, when receiving a force from above, the contact end of the plate material 51 is pressed against the developing roller 32 to maintain the developer accumulating portion 41 and the lower conveying path 37 in the partitioned state. When receiving a force from below, the plate material 51 is elastically deformed to separate its contact end from the developing roller 32 and the partitioned state between the developer accumulating portion 41 and the lower conveying path 37 is cancelled.

By the way, if the developing device was mounted in the tilted state or developer toner density increased and the developer filling in the casing 31 became partially dense or fluidity of developer became worse, developer pressure in the lower conveying path 37 will increase. In this case, developer tends to overflow from a gap G (shown in FIG. 4) between the developing roller 32 and the inner bottom surface of the casing 31.

At this time, however, the plate material 51 is pushed up by developer to separate its contact end from the developing roller 32 and draw up developer to the developer accumulating portion 41.

Accordingly, even if the developer pressure in the lower conveying path 37 increased, developer does not overflow from the gap G between the developing roller 32 and the inner bottom surface of the casing 31.

Further, in the first embodiment, as the block material 43 is provided simply by pushing it against the developing roller 32, developer cannot be drawn up to the developer accumulating portion 41 even when the developer pressure in the lower conveying path 37 increased. Accordingly, developer may possibly overflow from the gap G between the developing roller 32 and the inner bottom surface of the casing 31.

Figure 6:
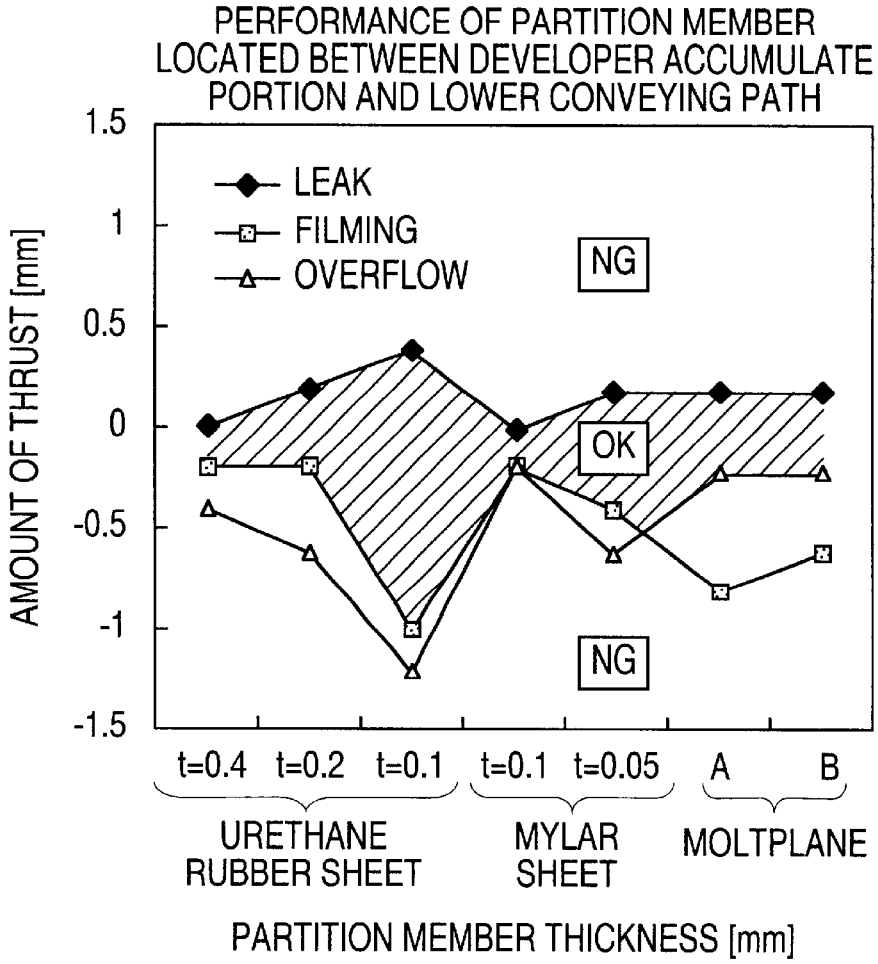
FIG. 6 is a graph showing thickness of the partition member and partition performance corresponding to change in amount of thrust to a developing roller.

FIG. 6 is a graph showing the performance of the partition member (urethane rubber, polyurethane foam) shown in the first and second embodiment corresponding to the thickness and changes in amount of thrust to the developing roller 32.

From this graph, it is seen that a plate material is advantageous to prevent the overflow of developer; however, if it is thicker and harder, its scraping force will increase and the filming and overflow tend to occur and further, in the case of a block material, overflow of developer also tends to occur.

Further, A shown in FIG. 6 means the polyurethane foam hardness of 10 degree and B means the polyurethane foam hardness of 35 degree. For measuring this hardness, Asker-C hardness meter (Kobunshi Keiki Co. made) that is generally called a durometer was used.

So, in the second embodiment a urethane rubber sheet in the thickness below 0.1 mm or a Mylar sheet in the thickness below 0.05 mm is used as the plate material.

TABLE 1

| Contact Projecting Length (mm) | Filming on Rotary Sleeve of Developing Roller |
|---|---|
| 0 | 0 |
| 1 | 0 |
| 2 | 0 |
| 3 | 0 |
| 4 | X |
| 5 | X |
| 6 | X |
| 8 | X |
| 10 | X |

0: None, X: Yes

Table 1 shows the relationship between the contact end projecting amount to the developing roller 32 of the plate material 51 and generation of the filming on the rotary sleeve 33.

Figure 7:
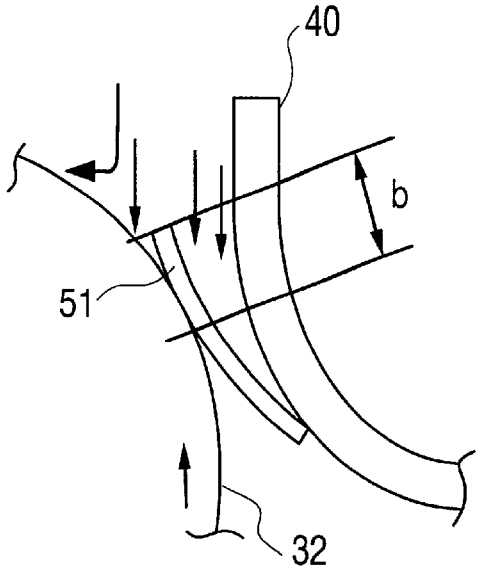
FIG. 7 is a schematic diagram showing amount of projection of the contacting edge of the partition member.

As shown in Table 1, even when the material of the plate material 51 and amount of thrust a (shown in FIG. 5) are proper, the flow of developer in the developer accumulating portion 41 becomes downward as shown by the arrow if the projecting length b (shown in FIG. 7) of the plate material 51 is made longer than 4 mm. In this case, the pressure around the plate material 51 rises and the filming (adherence of toner) to the rotary sleeve 33 is generated.

As this invention provides a partition means to partition between the developer accumulating portion and the lower conveying path as described above, the leakage (flow) of developer from the developer accumulating portion to the lower conveying path can be prevented. Therefore, it is possible to certainly prevent defective supply and lack of conveying of developer to a portion to be developed.

Further, used developer flowing to the developer accumulating portion from the lower conveying path can be shut off, and without drawing up used developer, developer in proper density can be supplied to a portion to be developed.

Further, a partition means uses a soft plate material, where one end of this plate material is a contact end to contact the developing means and the other end is a fixed end, and the direction toward the contact end from the fixed end is the same as the rotating direction of the developing means. So, when pressure of developer in the lower conveying path rises, the contact end of the plate material is separated from the developing means and developer can be drawn up.

Accordingly, even when pressure of developer rises in the lower conveying path, developer is not over flown to the outside.

Further, as the amount of projection of the contact end is set within the predetermined size, contact pressure of the contact end of the plate material to the developing means can be made small and the developer filming can be prevented.

What is claimed is:

1. A developing device comprising:

developing means, which is rotatable, for supplying developer to a developing portion;

first stirring/conveying means for stirring and conveying the developer to the developing means, wherein the developer is supplied by the first stirring/conveying means to the developing means by way of a developer accumulating portion that is formed at a location along a rotating direction of the developing means and, at this location, supplies the developer to the developing means;

second stirring/conveying means, provided below the first stirring/conveying means, for circulating and conveying a residual developer left on the developing means to the first stirring/conveying means; and partition means for controlling the developer in the developer accumulating portion from being directly supplied to the second stirring/conveying means, wherein one end of the partition means is brought in contact with the developing means.

2. A developing device as claimed in claim 1, wherein the one end of the partition means is a contact end that is brought in contact with the developing means and another end is a fixed end, and a direction toward the contact end from the fixed end is the same as the rotating direction of the developing means.

3. A developing device as claimed in claim 2, wherein the partition means is a soft plate material.

4. A developing device as claimed in claim 3, wherein an amount of the contact end projecting toward the direction is below a predetermined size.

5. A developing device as claimed in claim 4, wherein the predetermined size is about 3 mm.

6. A developing device as claimed in claim 4, wherein the soft plate material is a thin sheet material such as urethane rubber or Mylar rubber.

7. A developing device as claimed in claim 6, wherein the predetermined size is about 3 mm.

8. An image forming apparatus comprising:

an image carrier;

latent image forming means for forming an electrostatic latent image on the image carrier;

developing means, which is rotatable, for supplying developer to the image carrier to form a visible image on the image carrier;

first stirring/conveying means for stirring and conveying the developer to the developing means, wherein the developer is supplied by the first stirring/conveying means to the developing means by way of a developer accumulating portion that is formed at a location along a rotating direction of the developing means and, at this location, supplies the developer to the developing means;

second stirring/conveying means, provided below the first stirring/conveying means, for circulating and conveying a residual developer left on the developing means to the first stirring/conveying means; and partition means for controlling the developer in the developer accumulating portion from being directly supplied to the second stirring/conveying means, wherein one end of the partition means is brought in contact with the developing means.

9. An image forming apparatus as claimed in claim 8, wherein the one end of the partition means is a contact end that is brought in contact with the developing means and another end is a fixed end, and a direction toward the contact end from the fixed end is the same as the rotating direction of the developing means.

10. An image forming apparatus as claimed in claim 9, wherein the partition means is a soft plate material.

11. An image forming apparatus as claimed in claim 10, wherein an amount of the contact end projecting toward the direction is below a predetermined size.

12. An image forming apparatus is claimed in claim 11, wherein the predetermined size is about 3 mm.

13. An image forming apparatus as claimed in claim 11, wherein the soft plate material is a thin sheet material such as urethane rubber or Mylar rubber.

14. An image forming apparatus as claimed in claim 13, wherein the predetermined size is about 3 mm.

15. A developing device comprising:

a developing roller configured to supply developer to a developing portion;

a first conveying path configured to guide a moving of the developer and from which the developer is supplied by the developing roller to the developing portion;

a first mixer configured to mix the developer while the developer is moving along the first conveying path;

a second conveying path configured to guide the moving of the developer, wherein a residual developer left on the developing roller is recovered to the second conveying path and conveyed to the first conveying path;

a second mixer configured to mix the developer while the developer is moving along the second conveying path; and a partition member arranged between the developing roller and the first conveying path to prevent leakage of the developer from between the developing roller and the first conveying path to the second conveying path directly, wherein one end of the partition member is brought in contact with the developing roller.

16. A developing device as claimed in claim 15, wherein the one end of the partition member is a contact end that is brought in contact with the developing roller and another end is a fixed end, and a direction toward the contact end from the fixed end is the same as a rotating direction of the developing roller.

17. A developing device as claimed in claim 16, wherein the partition member is a soft plate material.

18. A developing device as claimed in claim 17, wherein an amount of the contact end projecting toward the direction is below a predetermined size.

19. A developing device as claimed in claim 18, wherein the predetermined size is about 3 mm.

20. A developing device as claimed in claim 18, wherein the soft plate material is a thin sheet material such as urethane rubber or Mylar rubber.

21. A developing device as claimed in claim 20, wherein the predetermined size is about 3 mm.

* * * * *